United States Patent [19]

Frahm et al.

[11] 3,974,863

[45] Aug. 17, 1976

[54] VALVED WATER CONTAINER WITH SEAL

[76] Inventors: Carl E. Frahm; Shirley E. Frahm, both of 1428 Oak Meadow Road, Arcadia, Calif. 91106

[22] Filed: Feb. 27, 1975

[21] Appl. No.: 553,747

Related U.S. Application Data

[62] Division of Ser. No. 494,464, Aug. 5, 1974.

[52] U.S. Cl. ..... 141/18; 62/397; 222/131; 222/183; 222/185

[51] Int. Cl.[2] ..... B67D 5/62; B67D 5/60

[58] Field of Search ..... 141/18; 62/397; 222/131, 183, 185

[56] References Cited

UNITED STATES PATENTS

| | | | |
|---|---|---|---|
| 1,711,494 | 5/1929 | Giese | 62/397 |
| 2,237,246 | 4/1941 | Askin | 62/397 |
| 2,359,791 | 10/1944 | Ralston | 62/397 |
| 3,667,197 | 6/1972 | Fram et al. | 5/502 |

*Primary Examiner*—Richard E. Aegerter
*Assistant Examiner*—Steven L. Stephan
*Attorney, Agent, or Firm*—Lyon and Lyon

[57] ABSTRACT

A combination sealing, venting, mounting and filter element is positioned between a replaceable inverted water bottle and a water reservoir from which the water is dispensed. The element is snugly fitted within the mouth portion of the reservoir or olla of plastic material into which a dispensng valve is threaded. The element includes a venting channel in communication with a filter housing which is releasably secured to such element adjacent to an upwardly extending flange portion, the flanged portion being apertured for venting and also shaped to provide a sealing portion engaging the bottle. Also the element has a downwardly extending portion near its periphery for engagement of a flat surface of a housing for the reservoir.

1 Claim, 6 Drawing Figures

VALVED WATER CONTAINER WITH SEAL

The present application is a division of our U.S. patent application Ser. No. 494,464, filed Aug. 5, 1974.

The present invention relates to improved means and techniques useful in the art of dispensing bottled water and in general involves improvements in a filtered dispenser shown in our U.S. Pat. No. 3,667,197 issued June 6, 1972.

An object of the present invention is to provide an improved sealing element for positioning between a water bottle and an improved container referred to as an olla on which such bottle is supported in inverted condition.

Another object of the present invention is to provide an improved sealing element of this character which has the additional feature of providing a more dependable seal between the bottle and container which in this instance is an improved container or olla of plastic material releasable secured to such plastic olla.

Another object to the present invention is to provide an improved sealing element of this character which is snugly fitted within the new cylindrical olla to assure a good seal between these elements that prevent extraneous materials and crawling insects from entering space between the sealing element and the olla.

Other objects and advantages of the present invention will be apparent from the following description, reference being made to the accompanying drawings wherein.

Figure 1:
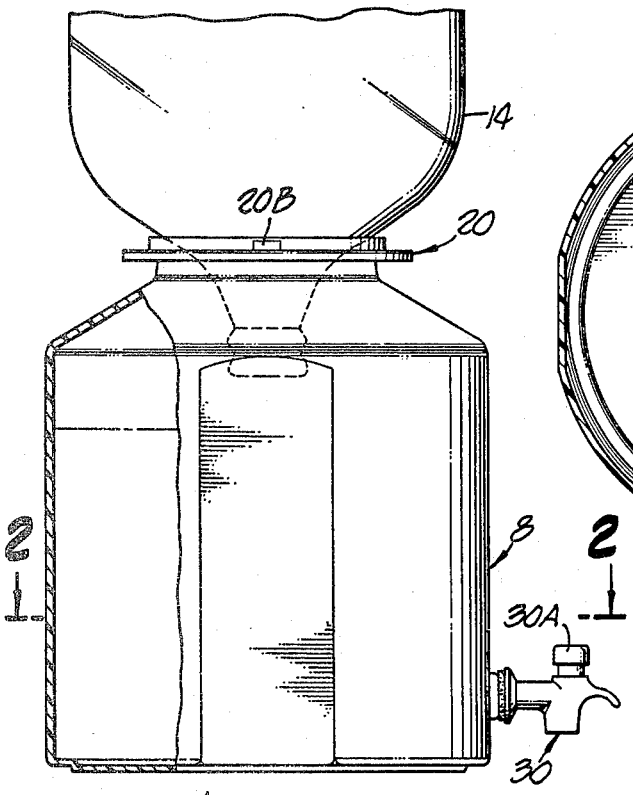
FIG. 1 is a side view, partly in section of essential elements of water dispenser embodying features of the present invention with a typical or conventional water bottle shown in relation to the combination sealing and venting and filtering means.
Figure 2:
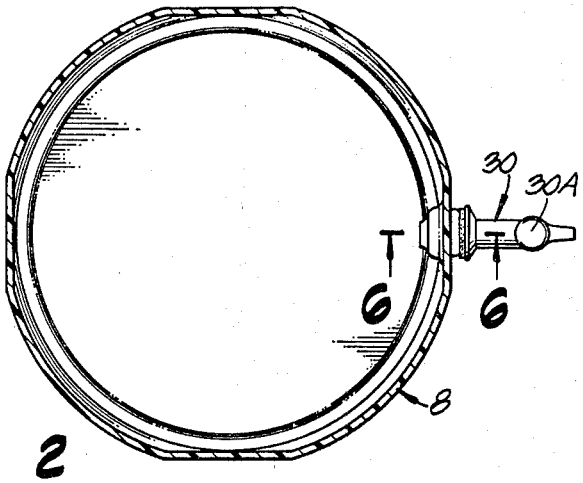
FIG. 2 is a view taken as indicated by the lines 2—2 in FIG. 1.
Figure 6:
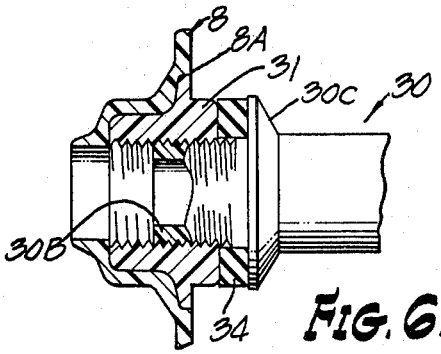
FIG. 6 is a sectional view on line 6—6 of FIG. 2.

A feature of this invention is that the conventional water bottle 14 of 5 gallon capacity may be supported on the new reservoir or olla 8 which is of plastic material with an improved sealing element 20 therebetween, a feature of this new sealing element 20 is that it is snugly received within the cylindrical mouth portion of the olla 8 so as to not only provide a means for supporting the bottle 14 on the olla 8 but also to provide an improved sealing arrangement which is particularly effective against dust, dirt, and crawling insects all of which are prevented from entering the olla by virtue of the snug fitting of element 20 within olla 8.

The open mouth portion of bottle 14 extends through said element 20 and into olla 8 with a portion of said bottle being engaged by an annular sealing portion 20F of element 20. Water flows by gravity and is dispensed through valve 30 upon pressing the valve actuator 30A downwardly.

The olla 8 of plastic is formed using blow molding techniques with an apertured portion 8A to receive a plastic internally threaded bushing 31, such bushing 31 being permanently secured in opening 8A by a epoxy or other means. The valve 30 has an externally threaded nipple portion 30B threaded within bushing 31 with a sealing gasket 34 between bushing 31 and valve flanged portion 30C.

The annular seal structure 20 is also of plastic material and is formed, in accordance with an important feature of the present invention, with a downwardly extending cylindrical portion 20M which snugly engages the inside of the olla neck portion 8E so as to provide not only a firm support for the bottle 14 but also as a seal which prevents dirt, dust, crawling insects and the like from entering the olla 8 and also as a means of sealing against possible leakage of water.

The presence of such sealing structure 20, if not vented would cause sub-atmospheric pressure to be developed in that internal space adjacent such seal when and as water is dispensed from the lower end of reservoir 12 and thus cause an objectionable diminution in rate of dispensed water flow. To obviate that problem, the sealing structure 20 is provided with a vent channel or bore 20A that extends through the sealing flange 20F of element 20 and terminates in a chamber 20B within whih a replaceable filter element 22 is frictionally held.

A purpose of such filter 22 is to filter the air which passes from the surrounding contaminated and dust or dirt laden atmosphere through such filter 22 and channel 20A into the air space above water in reservoir 8 in the automatic process of maintaining the desired full atmospheric pressure above the water in reservoir 8.

For these multipurposes, the combination sealing, venting, and filtering structure is of the construction now described in detail.

Figure 3:
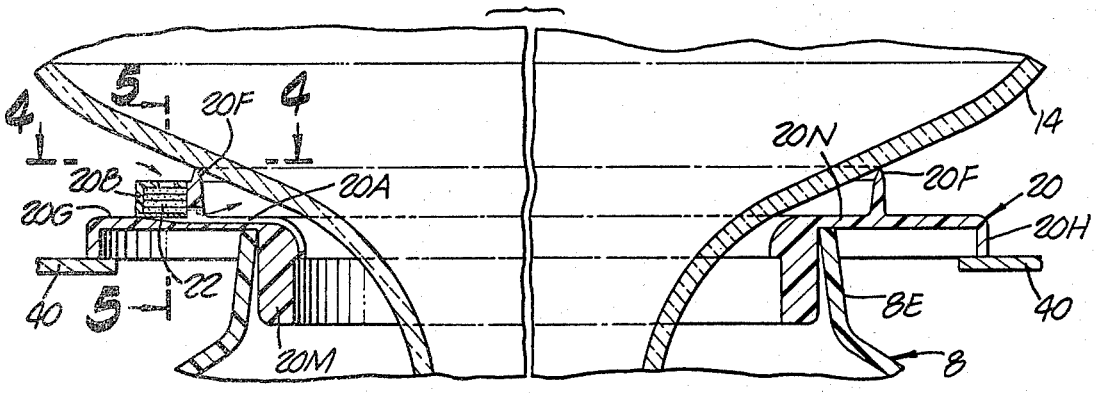
FIG. 3 is an enlarged sectional view of a portion of the structure shown in FIG. 1 but with the weight of a partially filled water bottle distorting the sealing means to effect a good seal.
Figure 4:
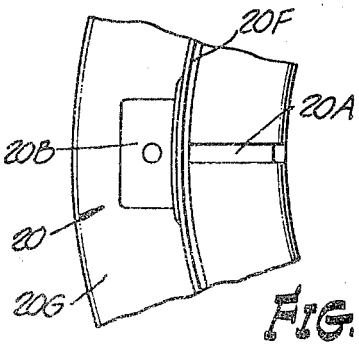
FIG. 4 and FIG. 5 are views taken substantially as indicated by the lines 4—4 and 5—5 in FIG. 3.

The sealing structure 20 is of plastic material in the general form of a ring which in cross section includes, as seen in FIG. 3 the relatively heavy sealing and mounting flange 20M which is contigous with a relatively thin circular portion 20N from which a thin wall flexible and tapered sealing ring portion 20F extends upwardly as a cantilever to sealingly contact the outer surface of water bottle 14. Also, this base portion 30E has a generally L-shaped flange portion 20G extending radially outwardly therefrom with its downwardly extending leg 20H for sealingly contacting a flat surface of a mounting stand 40 that surrounds the olla 8 and upon which the olla 8 rests, the horizontally extending leg portion 20H being sufficiently prolonged and sufficiently thin in cross section to be flexible to assure a good seal with stand 40 despite any irregularities in its surface.

Likewise the base portion of element 20 betwen the two flanged portions 20F and 20M is sufficiently resilient to accomplish these purposes.

Figure 5:
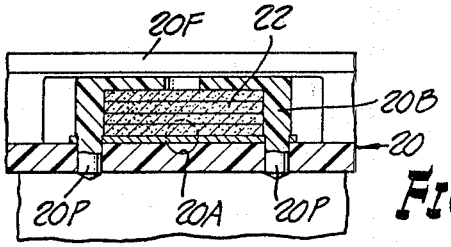

The previously mentioned chamber 20B which frictionally receives and retains filter element 22 is releasably secured to the sealing ring 20 as seen in FIG. 5 using a pair of circular extensions 20P snugly fitted within corresponding apertured portions in element 20.

This filter element 22 may be replaced each time a bottle is emptied and replaced by a filled bottle.

We claim:

1. An element for positioning between, on the one hand, a housing for a water reservoir having a mouth portion and, on the other hand, an inverted replaceable water container with said element serving the functions of mounting, sealing and venting, said element being annular and having a base portion, a first relatively heavy sealing and mounting portion extending downwardly from said base portion for entering and snugly engaging an inner wall portion of said mouth portion to provide not only a firm support for the water container but also as a seal, a second relatively thin, flexible and tapered sealing ring portion on said base portion positioned outwardly of said first portion and extending upwardly from said base portion and being the sole means to engage said container, said second portion having a vent apertured portion extending therethrough, a third portion near the periphery of said base portion and extending downwardly therefrom for sealingly contacting a flat surface of said housing for said reservoir, (to engage a portion of the housing in which said reservoir is mounted), said second portion being located between said first portion and said third portion and being joined to said first portion by a relatively thin circular portion, (rigidly supported by said first and said third portion when said water container is positioned to said mouth portion).

* * * * *

UNITED STATES PATENT OFFICE

CERTIFICATE OF CORRECTION

Patent No. 3,974,863 Dated August 17, 1976

Inventor(s) Carl E. Frahm; Shirley E. Frahm

It is certified that error appears in the above-identified patent and that said Letters Patent are hereby corrected as shown below:

In the claim delete the brackets and those portions included in the brackets, namely:

"(to engage a portion of the housing in which said reservoir is mounted)" and "(rigidly supported by said first and said third portion when said water container is positioned to said mouth portion)".

Signed and Sealed this

Second Day of November 1976

[SEAL]

*Attest:*

RUTH C. MASON
*Attesting Officer*

C. MARSHALL DANN
*Commissioner of Patents and Trademarks*